US012296235B2

(12) United States Patent
Hettinger et al.

(10) Patent No.: US 12,296,235 B2
(45) Date of Patent: May 13, 2025

(54) MODULAR GOLF CLUB INCLUDING AN INTERCHANGEABLE SOLE

(71) Applicant: Acushnet Company, Fairhaven, MA (US)

(72) Inventors: Ronald K. Hettinger, Oceanside, CA (US); Eddie G. Perez, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 18 days.

(21) Appl. No.: 18/308,765

(22) Filed: Apr. 28, 2023

(65) Prior Publication Data

US 2024/0359064 A1 Oct. 31, 2024

(51) Int. Cl.
*A63B 53/04* (2015.01)
*A63B 53/08* (2015.01)

(52) U.S. Cl.
CPC ..... *A63B 53/0433* (2020.08); *A63B 53/08* (2013.01); *A63B 2053/0491* (2013.01)

(58) Field of Classification Search
CPC ..... A63B 53/04; A63B 53/047; A63B 53/06
See application file for complete search history.

(56) References Cited

U.S. PATENT DOCUMENTS 1,135,621 A * 4/1915 Roberts ..... A63B 53/06 473/245
3,220,733 A 11/1965 Saleeby
3,419,275 A 12/1968 Winkleman
4,540,178 A * 9/1985 Johnson ..... A63B 60/00 228/101
4,708,347 A 11/1987 Kobayashi
5,230,509 A * 7/1993 Chavez ..... A63B 53/0487 473/336
5,807,186 A 9/1998 Chen
5,938,540 A 8/1999 Lu
6,569,029 B1 5/2003 Hamburger
7,452,283 B2 * 11/2008 Hettinger ..... A63B 53/0487 473/331
7,473,186 B2 * 1/2009 Best ..... A63B 53/0487 473/340
7,771,290 B2 8/2010 Bezilla
8,033,931 B2 10/2011 Wahl
8,062,151 B2 11/2011 Boyd
8,133,128 B2 * 3/2012 Boyd ..... A63B 60/00 473/290
8,133,129 B2 * 3/2012 Boyd ..... A63B 53/047 473/335
8,409,028 B2 4/2013 Wahl
8,435,137 B2 * 5/2013 Hirano ..... A63B 53/0466 473/345
8,491,405 B2 7/2013 Jorgensen
(Continued)

FOREIGN PATENT DOCUMENTS

JP 2006026301 A * 2/2006 ..... A63B 53/0487
JP 2008272274 A * 11/2008
(Continued)

*Primary Examiner* — Alvin A Hunter
(74) *Attorney, Agent, or Firm* — Mike S. Kim

(57) ABSTRACT

The presently disclosed technology is directed to a modular golf club. In particular, the modular golf club includes at least one interchangeable sole component to allow adjustability of various characteristics of the modular golf club.

17 Claims, 7 Drawing Sheets

(56) References Cited

U.S. PATENT DOCUMENTS

| | | | | |
|---|---|---|---|---|
| 9,033,814 | B2 | 5/2015 | Stites | |
| 9,901,792 | B2 * | 2/2018 | Franklin | A63B 53/047 |
| 11,766,593 | B1 * | 9/2023 | Hebreo | A63B 53/08 473/334 |
| 2002/0065144 | A1 * | 5/2002 | Helmstetter | C08G 18/10 473/340 |
| 2004/0132541 | A1 * | 7/2004 | MacIlraith | A63B 60/00 473/334 |
| 2006/0100028 | A1 * | 5/2006 | Kuo | A63B 60/02 473/345 |
| 2006/0178229 | A1 | 8/2006 | Liang | |
| 2007/0021236 | A1 * | 1/2007 | Tucker | A63B 53/06 473/340 |
| 2008/0153619 | A1 * | 6/2008 | Tucker | A63B 53/065 473/409 |
| 2009/0270199 | A1 * | 10/2009 | Chen | A63B 53/0466 473/348 |
| 2009/0291772 | A1 * | 11/2009 | Boyd | A63B 60/00 473/335 |
| 2010/0016098 | A1 | 1/2010 | Tavares | |
| 2010/0041495 | A1 * | 2/2010 | North, III | A63B 53/06 473/349 |
| 2010/0099511 | A1 | 4/2010 | Stites | |
| 2011/0165961 | A1 | 7/2011 | Cackett | |
| 2012/0064997 | A1 * | 3/2012 | Sato | A63B 60/02 473/349 |
| 2012/0238375 | A1 * | 9/2012 | Park | A63B 53/047 473/331 |
| 2013/0109497 | A1 * | 5/2013 | Ban | A63B 53/047 473/330 |
| 2013/0137533 | A1 * | 5/2013 | Franklin | A63B 53/047 473/349 |
| 2013/0165251 | A1 * | 6/2013 | Jorgensen | A63B 53/047 473/328 |
| 2013/0310191 | A1 | 11/2013 | Cackett | |
| 2013/0324276 | A1 * | 12/2013 | Stites | A63B 53/047 473/324 |
| 2014/0274441 | A1 * | 9/2014 | Greer | A63B 53/047 473/328 |
| 2016/0193511 | A1 * | 7/2016 | Greer | A63B 53/06 473/290 |
| 2017/0095707 | A1 * | 4/2017 | Ripp | A63B 53/06 |
| 2017/0095708 | A1 * | 4/2017 | Ripp | A63B 53/06 |
| 2019/0001196 | A1 * | 1/2019 | Sizemore, Jr. | A63B 60/02 |
| 2023/0330499 | A1 * | 10/2023 | Yi | A63B 60/52 |

FOREIGN PATENT DOCUMENTS

| | | | | |
|---|---|---|---|---|
| JP | 2009297210 | A * | 12/2009 | |
| JP | 2010273804 | A * | 12/2010 | A63B 53/0466 |
| JP | 2012192179 | A * | 10/2012 | A63B 53/04 |
| JP | 2015019998 | A * | 2/2015 | A63B 53/02 |
| JP | 2017080387 | A * | 5/2017 | A63B 53/047 |
| JP | 2020103861 | A * | 7/2020 | |
| JP | 2021090722 | A * | 6/2021 | A63B 53/0487 |

* cited by examiner

MODULAR GOLF CLUB INCLUDING AN INTERCHANGEABLE SOLE

FIELD OF THE DISCLOSURE

The present disclosure generally relates to golf clubs, and more specifically to a modular golf club including an interchangeable sole.

SUMMARY

Embodiments of the presently disclosed technology may include modular golf clubs. In accordance with some aspects of the presently disclosed technology, a modular golf club head may include a body portion. The body portion may include a face. The body portion may include a back. The back may extend rearward from at least a first portion of the face. The modular golf club head may include at least one interchangeable sole to fit with the back. The at least one interchangeable sole may include a removably couplable intermediate sole piece to fit with at least a second portion of the back. The removably couplable intermediate sole piece may be removably couplable to the back. The at least one interchangeable sole may include a removably couplable rear sole piece to fit with the removably couplable intermediate sole piece. The removably couplable rear sole piece may be removably couplable to the removably couplable intermediate sole piece and the back.

In embodiments, the back may include a threaded bore to receive a fastener. The removably couplable intermediate sole piece may include an intermediate sole through bore to receive the fastener to removably couple the removably couplable rear sole piece to the removably couplable intermediate sole piece and the back. The removably couplable rear sole piece may include a sole through bore to receive the fastener to removably couple the removably couplable rear sole piece to the removably couplable intermediate sole piece and the back.

In embodiments, the removably couplable intermediate sole piece may further include an intermediate through bore to receive an intermediate fastener to removably couple the removably couplable intermediate sole piece to the back.

In embodiments, the back may further include a bore to receive an alignment pin. The removably couplable intermediate sole piece may further include the alignment pin to help secure the removably couplable intermediate sole piece to the back via the bore. The removably couplable intermediate sole piece may further include a slot to receive a securing element. The removably couplable rear sole piece may further include the securing element to help secure the removably couplable rear sole piece to the removably couplable intermediate sole piece via the slot.

In embodiments, the back may further include a body recess to receive an adjustable weight. A heel-to-toe body recess length may be longer than a heel-to-toe weight length of the adjustable weight. The removably couplable intermediate sole piece may further include an intermediate cut-out extending from a front through to a back of the removably couplable intermediate sole piece to receive the adjustable weight. A heel-to-toe cut-out length may be at least the heel-to-toe body recess length. The removably couplable rear sole piece may further include a sole recess on a front of the removably couplable rear sole piece to receive the adjustable weight. A heel-to-toe sole recess length may be at least the heel-to-toe body recess length.

In embodiments, coupling the at least one interchangeable sole to the body portion may secure the adjustable weight into a fixed position.

In embodiments, the removably couplable rear sole piece may further include an indicator to indicate a position of the adjustable weight along the modular golf club head.

In embodiments, the at least one interchangeable sole may include a first material and a second material. The first material may be denser than the second material.

In embodiments, the first material may be located substantially face-ward and a second material may be located substantially rearward causing the modular golf club head to be weight-biased toward the face or vice versa.

In embodiments, the first material may be located substantially heel-ward and a second material may be located substantially toe-ward causing the modular golf club head to be weight-biased toward a heel or vice versa.

In embodiments, coupling the at least one interchangeable sole to the body portion may cause the modular golf club head to include one of an f grind, an s grind, an m grind, a d grind, an l grind, and a k grind.

In embodiments, coupling the at least one interchangeable sole to the body portion may cause the modular golf club head to include a bounce angle between about 2° and about 20°.

In accordance with some aspects of the presently disclosed technology, a modular golf club head may include a body portion. The body portion may include a face. The body portion may include a back extending rearward from at least a first portion of the face. The back may include a body recess to receive an adjustable weight. A heel-to-toe body recess length may be longer than a heel-to-toe weight length of the adjustable weight. The modular golf club head may include at least one interchangeable sole to fit with the body portion. The at least one interchangeable sole may include a recess on a front of the at least one interchangeable sole to receive the adjustable weight. A heel-to-toe recess length may be at least the heel-to-toe body recess length.

In embodiments, the back may further include a threaded bore to receive a fastener. The at least one interchangeable sole may include a through bore to receive the fastener to removably couple the at least one interchangeable sole to the back.

In embodiments, the at least one interchangeable sole may include a removably couplable intermediate sole piece to fit with the back. The removably couplable intermediate sole piece may be removably couplable to the back. The removably couplable intermediate sole piece may further include an intermediate cut-out extending from a front through to a back of the removably couplable intermediate sole piece to receive the adjustable weight. A heel-to-toe cut-out length may be at least the heel-to-toe recess length. A removably couplable rear sole piece may fit with the removably couplable intermediate sole piece. The removably couplable rear sole piece may be removably couplable to the removably couplable intermediate sole piece and the back. The removably couplable rear sole piece may further include a sole recess on a front of the removably couplable rear sole piece to receive the adjustable weight. A heel-to-toe sole recess length may be at least the heel-to-toe body recess length. The recess may include the intermediate cut-out and the sole recess.

In embodiments, the back may include a threaded bore to receive a fastener. The at least one interchangeable sole may include a through bore to receive the fastener to removably couple the at least one interchangeable sole to the back. The removably couplable intermediate sole piece may include an intermediate sole through bore to receive the fastener to removably couple the removably couplable rear sole piece to the removably couplable intermediate sole piece and the back. The removably couplable rear sole piece may include a sole through bore to receive the fastener to removably couple the removably couplable rear sole piece to the removably couplable intermediate sole piece and the back.

In accordance with some aspects of the presently disclosed technology, a modular golf club head may include a body portion. The body portion may include a face. The body portion may include a back extending rearward from at least a first portion of the face. The modular golf club head may include at least one interchangeable sole to fit with the back. The at least one interchangeable sole may include a first side and a second side on an opposite end of the first side. The modular golf club head may be weight-biased toward at least a first side.

In embodiments, the first side may include a first material. The second side may include a second material. The first material may be denser than the second material.

In embodiments, the back may include a body recess on a rear of the back to receive an adjustable weight. The body recess may be larger in at least one body dimension than a corresponding dimension of the adjustable weight. The at least one interchangeable sole may include the adjustable weight. The at least one interchangeable sole may include a recess on a front of the at least one interchangeable sole to receive the adjustable weight. A recess dimension may be at least the at least one body dimension.

In embodiments, coupling the at least one interchangeable sole to the back may form a substantially continuous shape between the face and a sole back of the at least one interchangeable sole to provide a uniform appearance of the modular golf club head. The substantially continuous shape may include a leading edge and a trailing edge.

Figure 1:
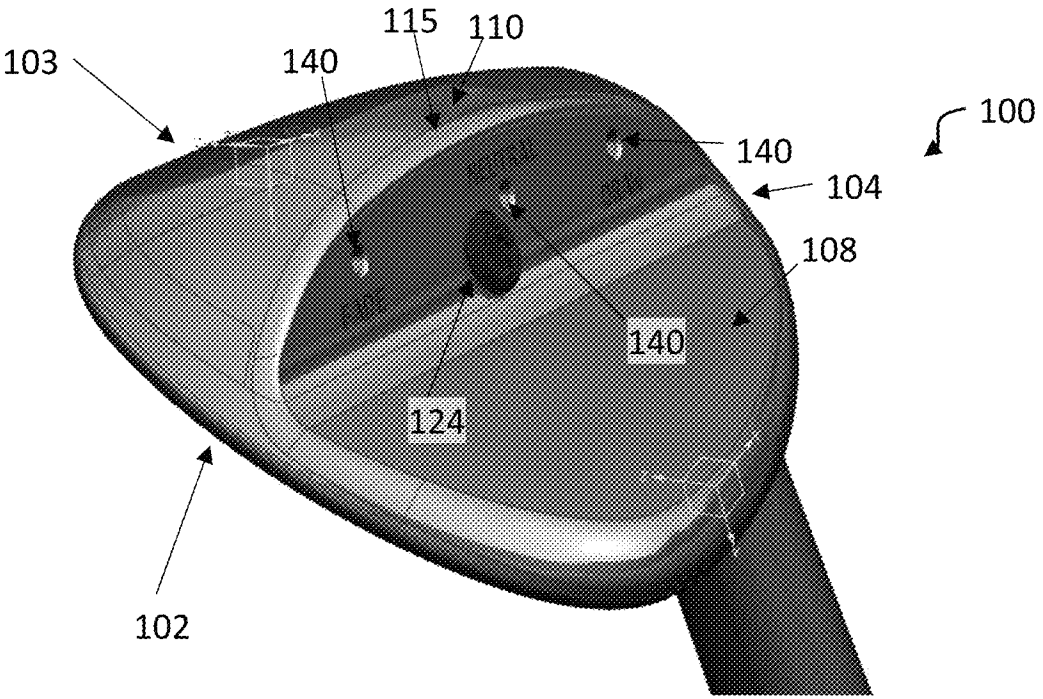
FIG. 1 is a perspective view of a modular golf club head in accordance with one or more embodiments of the presently disclosed technology.

These and other features of the presently disclosed technology, as well as the methods of operation and functions of the related elements of structure and the combination of parts, may be clearer upon consideration of the following detailed description and the claims with reference to these drawings, all of which form a part of this specification, with like reference numerals designating corresponding parts in the various figures. It is to be expressly understood that these drawings are for illustration purposes and description and are not intended to be limiting. It should be noted that for clarity and ease of illustration these drawings are not necessarily made to scale. As used in the specification and in the claims, the singular form of "a", "an", and "the" may include plural referents unless the context clearly dictates otherwise.

DETAILED DESCRIPTION

Depending on a location of a golf ball, a user may need to use different clubs to appropriately interact with the ground and the ball. There does not exist a single golf club that can adapt to every situation. Golf club designers are forced to provide a limited number of models of golf clubs to apply to the majority of golfers and to a majority of situations. Typically, the construction of the golf club, especially for iron-type and wedge-type golf clubs, includes a single structural component that includes a body, a face, a sole, and a hosel. In multi-material constructions, the parts of the golf club head are formed separately and then may be coupled during manufacturing of the club head, and the components may be permanently coupled. Some existing golf clubs may allow entire golf club heads to be removed and adjusted. Still others may provide for face inserts. However, there is still a need for an improved modular golf club head that provides greater ability to alter the shape of a sole of the golf club head by including interchangeable components to affect a golf club head.

The presently disclosed technology is directed to a modular golf club. The modular golf club may include a grip, a shaft, a hosel, a body portion, and at least one interchangeable sole. The modular golf club may be used to adjust characteristics of a golf club head. For example, the modular golf club may include components to adjust the bounce angle of the modular golf club, the center of gravity (CG) of the modular golf club, the materials of the modular golf club, the aesthetics of the modular golf club, the trailing edge of the modular golf club, width of the sole of the modular golf club, and/or other characteristics. The presently disclosed technology may allow a user to quickly and easily modify the characteristics of the modular golf club depending on the user's situation (e.g., fairway, rough, sand, and so on).

The body portion of the modular golf club head may include a face and a back. The face may include scorelines, a topline, a lower face edge, and/or other elements. The back may include a lower back portion and an upper back portion. The at least one interchangeable sole may fit with the lower back portion to form a substantially continuous shape from the lower face edge to the at least one interchangeable sole. In some embodiments, the substantially continuous shape may be understood to come from at least a leading edge to at least a trailing edge, as will be described in greater detail herein. Coupling the at least one interchangeable sole to the lower back portion makes the modular golf club appear as if it is a traditional golf club. In embodiments, the at least one interchangeable sole may include a removably couplable intermediate sole piece and a removably couplable rear sole piece. The removably couplable intermediate sole piece may fit with the lower back portion. The removably couplable rear sole piece may fit with the removably couplable intermediate sole piece.

FIG. 1 is a perspective view of modular golf club head 100 in accordance with one or more embodiments of the presently disclosed technology. Modular golf club head 100 generally includes a body portion, which includes face 102 and back 104, interchangeable sole 110, and fastener 124. Face 102 may include a leading edge, which will be described in greater detail herein. Back 104 may extend rearward from at least a portion of face 102. In embodiments, the body portion may be solid. In some embodiments, the body portion may be hollow. Back 104 may include a lower back portion 206 (shown in FIG. 2) and upper back portion 108. Lower back portion 206 (shown in FIG. 2) is not shown here in FIG. 1 because it has been obstructed by interchangeable sole 110. Lower back portion 206 (shown in FIG. 2) may extend rearward from a bottom edge of face 102. Lower back portion 206 (shown in FIG. 2) may be raised compared to upper back portion 108. In embodiments, lower back portion 206 (shown in FIG. 2) may be flush with upper back portion 108. In some embodiments, lower back portion 206 (shown in FIG. 2) may be depressed when compared to the upper back portion 108. It should be appreciated that different curves and/or shapes may be used between lower back portion 206 (shown in FIG. 2) and upper back portion 108. Lower back portion 206 (shown in FIG. 2) may fit with interchangeable sole 110. Lower back portion 206 (shown in FIG. 2) may include bore 228 (shown in FIG. 2) to receive fastener 124. Fastener 124 may help secure interchangeable sole 110 to back 104.

Figure 2:
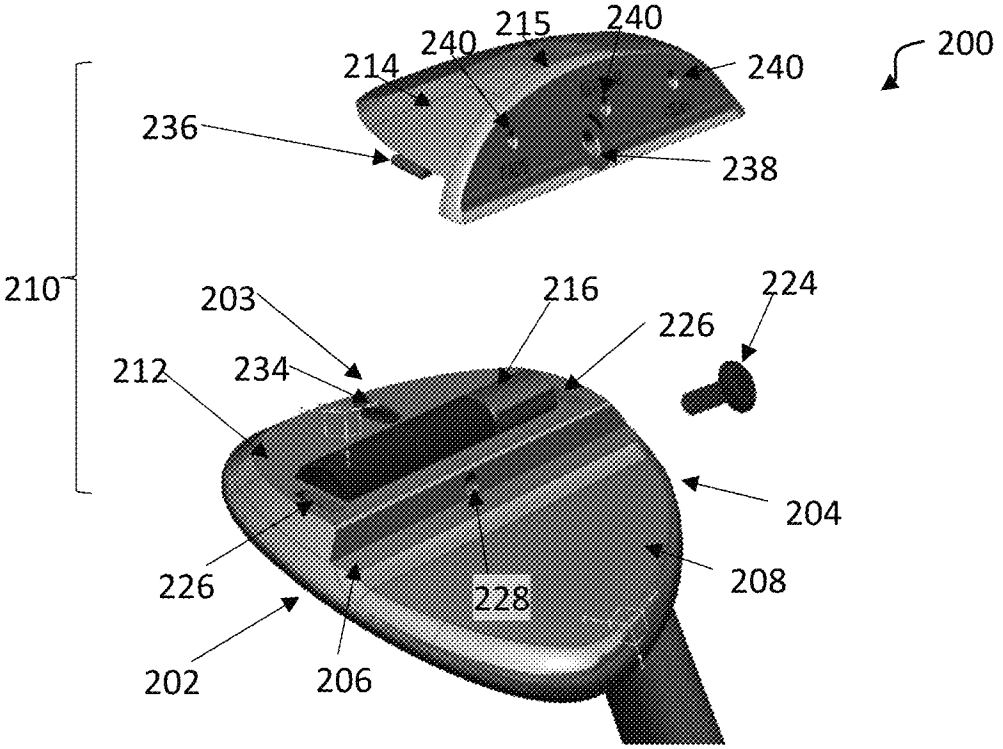
FIG. 2 is a perspective exploded view of a modular golf club head in accordance with one or more embodiments of the presently disclosed technology.

Upper back portion 108 may extend upward from lower back portion 206 (shown in FIG. 2). In embodiments, upper back portion 108 may extend rearward from a top edge of face 102. In some embodiments, upper back portion 108 may be used to help secure interchangeable sole 110 to the body portion. For example, this may include a bore (not shown), a fastener (not shown), and/or another mechanism. In some embodiments, bore 418 (shown in FIG. 4) of lower back portion 206 (shown in FIG. 2) may be threaded, which may be referred to herein as a threaded bore 418 (shown in FIG. 4), to help secure fastener 124 to lower back portion 206 (shown in FIG. 2).

In embodiments, fastener 124 may be made out of metal, plastic, composite, and/or other materials. For example, fastener 124 may be made from tungsten, steel, brass, titanium, epoxy, nylon, and the like. In some embodiments, fastener 124 may add weight to modular golf club head 100 to affect a center of gravity (CG) of modular golf club head 100, which will be described in greater detail herein.

Interchangeable sole 110 may include one piece or multiple pieces, as will be described in greater detail herein. Coupling interchangeable sole 110 to back 104 may form a substantially continuous shape between face 102 and interchangeable sole 110 to provide a uniform appearance of modular golf club head 200, as modular golf club head 100 is illustrated. A uniform appearance may make it hard to visually distinguish modular golf club head 100 from a traditional golf club head. In some embodiments, a uniform appearance and a substantially continuous shape may refer to not interfering with a user's intended interaction with modular golf club head 100. The substantially continuous shape may include leading edge 103 and trailing edge 115. Leading edge 103 may refer to a lower edge of face 102. Trailing edge 115 may refer to a rearward edge of interchangeable sole 110. This portion of a sole may include the area of the club that interacts with the ground as the club contacts the ball. Trailing edge 115 may affect a performance of modular golf club head 200. For example, interchangeable sole 110 may provide modular golf club head 100 with the ability to alter a grind and a bounce angle.

A grind may refer to resultant golf club head 100 with a sole that mimics the process of making golf club heads involving the removal ("grinding") of material from a sole to affect the club's contact with the ground. Coupling interchangeable sole 110 to back 104 may cause modular golf club head 200 to have an f grind, an s grind, an m grind, a d grind, an l grind, or a k grind. A bounce angle may refer to an angle between a club's leading edge and a club's trailing edge. Together, the grind and the bounce may affect ball spin, flight, power, and/or other factors. Coupling interchangeable sole 210 to the body portion may cause modular golf club head 200 to have a bounce angle between about 2° and about 20°. It should be appreciated that different interchangeable soles may each have an individual grind and bounce, which would allow a user to easily modify the grind and/or bounce without needing an entire new club. This may be a cost-effective way to have multiple grinds and/or bounces without needing an entire new golf club to achieve such characteristics. It may also allow further creativity for a user to switch grinds and/or bounces by quickly changing out interchangeable sole 110. In some embodiments, different interchangeable soles may also provide a wider or narrower sole. In embodiments, a set of interchangeable soles may be customized to a specific body portion. In some embodiments, a set of interchangeable soles may be interchangeable with various body portions, including, for example, clubs with different lofts, clubs with the same lofts, different models of the same club, and so on.

Interchangeable sole 110 may include trailing edge 115, indicators 140, and sole through bore 228 (shown in FIG. 2). Sole through bore 228 (shown in FIG. 2) may receive fastener 124. In embodiments, sole through bore 228 (shown in FIG. 2) may be threaded. In some embodiments, interchangeable sole 110 may be evenly weighted throughout interchangeable sole 110. In some embodiments, interchangeable sole 110 may be weight-biased toward a side of modular golf club head 100. For example, interchangeable sole 110 may include adjustable weight 216 (shown in FIG. 2), which will be described in greater detail herein. In some embodiments, interchangeable sole 110 may be a dual- or multi-density material, which will be described in greater detail herein.

In embodiments, interchangeable sole 110 may cover and/or secure adjustable weight 216 (shown in FIG. 2), which will be described in greater detail herein. A position of adjustable weight 216 (shown in FIG. 2) may be visible through indicators 140. Moving adjustable weight 216 (shown in FIG. 2) may affect the CG of modular golf club head 100 up to about 10 mm in a heel-to-toe direction, about 5 mm in a front-to-back direction, and about 5 mm in a bottom-to-top direction using the presently disclosed technology. In some embodiments, interchangeable sole 110 may include recess 330 (shown in FIG. 3), which will be described in greater detail herein, to help secure adjustable weight 216 (shown in FIG. 2). In embodiments, adjustable weight 216 (shown in FIG. 2) may be removed.

As illustrated by the label "FADE" underneath indicator 140, positioning adjustable weight 216 (shown in FIG. 2) closer to the toe may provide a user with a "fade"-type shot. A fade-type shot may be a shot where a ball curves from left-to-right in the air for a right-handed player. As illustrated by the label "DRAW" underneath indicator 140, positioning adjustable weight 216 (shown in FIG. 2) closer to the heel may provide a user with a "draw"-type shot. A draw-type shot may be a shot where a ball curves from right-to-left in the air for a right-handed player. As illustrated by the label "NEUTRAL" underneath indicator 140, positioning adjustable weight 216 (shown in FIG. 2) near or at the center may provide a user with a "neutral"-type shot. A neutral-type shot may be a shot where a ball does not curve left or right in the air. While indicators 140 may be illustrated as through holes in FIG. 1, it should be appreciated that indicators 140 may be a window, a through slot, and/or other visual indicators without departing from the spirit and scope of the presently disclosed technology. It should also be appreciated that while indicators 140 indicate movement of adjustable weight 216 (shown in FIG. 2) along a heel-to-toe length, adjustable weight 216 (shown in FIG. 2) may be movable from the front to the back and/or a top to a bottom.

In some embodiments, interchangeable sole 110 may include a first material and a second material. The first material may be denser than the second material. It should be appreciated that interchangeable sole 110 may be a unitary piece that includes multiple materials. Interchangeable sole 110 may include a first side and a second side. The first side may include the first material, and the second side may include the second material. The first side may be a heel, a toe, a top, a bottom, face 102, or a rear. In some embodiments, the second side may be on an opposite end of the first side. The second side may be a toe, a heel, a top, a bottom, a rear, or face 102. A location of the first material and the second material, when interchangeable sole 110 is coupled to back 204 of modular golf club head 100, may affect the overall CG location of modular golf club head 100, as discussed herein. In some embodiments, the first material may be metal, composite, and/or plastic. The second material may be metal, composite, and/or plastic. In one example, the first material may be metal, and the second material may be composite or plastic. In another example the first material may be a denser metal and the second material may be a less dense metal. The metal used may include tungsten, steel, titanium, aluminum, scandium, zinc, nickel, copper, iron, alloys, and/or other metals without departing from the spirit and scope of the presently disclosed technology. Composites may include a variety of materials known to those skilled in the art, including for example, graphite, carbon fiber, resins, ceramics, boron fiber, polymers, foams, and so on.

In some embodiments, interchangeable sole 110 may be made by slicing at least a portion of a sole off of a golf club head. In some embodiments, the body portion may be made separately from interchangeable sole 110. In embodiments, the body portion and/or interchangeable sole 110 may be forged, cast, injected, machined, fabricated, assembled, and/or otherwise made. In some embodiments, the body portion may be metal, composite, plastic, and/or other materials. In some embodiments, interchangeable sole 110 may be metal, composite, plastic, and/or other materials. It should be appreciated that interchangeable sole 110 and/or the body portion may have different hardness and/or rebound characteristics. Hardness may be a degree to which a material resists penetration and/or scratching. Hardness may be measured using the Rockwell Hardness Scale, though it should be appreciated that other scales may be used. Rebound may be a measure of how resilient a material is to elastic deformation. Resilience may be a measure comparing the energy given up in recovery from deformation to the energy required to produce the deformation. In some embodiments, interchangeable sole 110 and/or the body portion may have the same or similar characteristics.

In some embodiments, intermediate fastener 234 may help secure removably couplable intermediate sole piece 212 to the body portion. Similar to fastener 224, intermediate fastener 234 may be made out of metal, plastic, composite, and/or other materials, as described herein.

FIG. 2 is a perspective exploded view of modular golf club head 200 in accordance with one or more embodiments of the presently disclosed technology. FIG. 2 illustrates components that may be the same or substantially similar to components illustrated in FIG. 1. For example, face 102, leading edge 103, back 104, upper back portion 108, trailing edge 115, fastener 124, and/or indicators 140 may be the same as or substantially similar to face 202, back 204, upper back portion 208, fastener 224, and/or indicators 240. Weight 216 may sit within interchangeable sole 210. In embodiments, weight 216 may be a cylindrical weight, but it should be appreciated that weight 216 may be a flat weight, a rectangular-shaped weight, a pyramidal-shaped weight, a single-density weight where the density may be consistent throughout weight 216, a biased weight, or a multiple-density weight where there may be more weight on a front or back, a heel or a toe, and/or a top or bottom, solid weights, hollow weights, semi-solid weights that are partially solid and partially hollow, and/or other types of weights without departing from the spirit and scope of the presently disclosed technology. In some embodiments, weight 216 may be made up of multiple components. For example, weight 216 may include two light components and a heavier component. The heavier component may be tungsten and may weigh between 10 grams/cubic centimeter (g/cc) to 25 g/cc. The light components may be plastic and may weigh less than 5 g/cc. In some embodiments with a biased weight, a visual indicator (not shown) may be located on or above weight 216 to indicate a position of weight 216 along the modular golf club head. It should be appreciated that in some embodiments, the visual indicator (not shown) may include a label, a mark, a color, a dimple, a bump, a forged line, a sticker, removable visual indicator, and/or another type of visual indicator. In some embodiments, weight 216 itself may include a visual indicator. As illustrated, a heavier end of weight 216 is lighter in color, and the lighter end of weight 216 is darker in color. It should be appreciated that weight 216 may use various visual indicators as described herein to differentiate a heavier side from a lighter side, including through indicator 240 windows.

Interchangeable sole 210 may further include removably couplable intermediate sole piece 212 and removably couplable rear sole piece 214. As described herein, interchangeable sole 210 may be made by slicing at least a portion of a sole off of a golf club head. Similarly, removably couplable intermediate sole piece 212 and removably couplable rear sole piece 214 may be sliced or otherwise machined from each other to form two pieces, that is interchangeable sole 210 may be sliced in two to form these two pieces. In some embodiments, the body portion, removably couplable intermediate sole piece 212, and removably couplable rear sole piece 214 may be made separately from each other. In embodiments, removably couplable intermediate sole piece 212 and removably couplable rear sole piece 214 may be forged, cast, injected, machined, fabricated, assembled, and/or otherwise made. In some embodiments, removably couplable intermediate sole piece 212 may be metal, composite, plastic, and/or other materials with corresponding rebound and/or hardness characteristics as described herein. In some embodiments, removably couplable rear sole piece 214 may be metal, composite, plastic, and/or other materials with corresponding rebound and/or hardness characteristics as described herein.

As illustrated, removably couplable intermediate sole piece 212 may include an intermediate cut-out 330 (shown in FIG. 3), slots 226, top intermediate sole through bore 228, and/or intermediate fastener 234. Removably couplable intermediate sole piece 212 may fit with back 204. In some embodiments, removably couplable intermediate sole piece 212 may fit with lower back portion 206. Removably couplable intermediate sole piece 212 may be removably couplable to back 204. In some embodiments, removably couplable intermediate sole piece 212 may be removably couplable to lower back portion 206.

In embodiments, the intermediate cut-out 330 (shown in FIG. 3) may extend through removably couplable intermediate sole piece 212, that is, intermediate cut-out 330 (shown in FIG. 3) may extend from a front through to a back of removably couplable intermediate sole piece 212, such that intermediate cut-out 330 (shown in FIG. 3) makes a hole through removably couplable intermediate sole piece 212. Intermediate cut-out 330 (shown in FIG. 3) may be able to receive weight 216. The dimensions of intermediate cut-out 330 (shown in FIG. 3), which may be referred to herein as intermediate cut-out dimensions, may be at least the dimensions of weight 216, which may be referred to herein as weight dimensions. As one example of a dimension, a heel-to-toe cut-out length, that is, a length of the cut-out from the heel to the toe, is at least a heel-to-toe weight length, that is, a length of weight 216 from the heel to the toe. In some embodiments, a heel-to-toe cut-out length may be longer than the heel-to-toe weight length. It should be appreciated that intermediate cut-out dimensions may include a bottom-to-top cut-out width and a rear-to-face cut-out depth. Similarly, weight dimensions may include a bottom-to-top weight width and a rear-to-face weight depth, while other dimensions may include a bottom-to-top width and a rear-to-face depth. In some embodiments, the intermediate cut-out 330 (shown in FIG. 3) may not be a hole and may be an intermediate recess (not shown) based on the rear-to-face weight depth being less than the intermediate cut-out depth. In some embodiments, the intermediate recess (not shown) may be on a front of removably couplable intermediate sole piece 212 or on a rear of removably couplable intermediate sole piece 212.

Slots 226 may receive securing element 236 that may be a part of removably couplable rear sole piece 214. In embodiments, slots 226 may include an undercut to help mechanically secure, or retain, securing element 236 of removably couplable rear sole piece 214 to slots 226. It should be appreciated that other grooves, recessed surfaces, protrusions, pins, and/or other mechanisms may be used to form securing element 236, which are also capable of helping secure securing element 236 to removably couplable rear sole piece 214 without departing from the spirit and scope of the presently disclosed technology. In some embodiments, these mechanisms may be reversed, that is removably couplable rear sole piece 214 may include slots 226 and the removably couplable intermediate sole piece 212 may include securing element 236.

In some embodiments, top intermediate sole through bore 228 may be used to help secure removably couplable intermediate sole piece 212 to the body portion. In some embodiments, top intermediate sole through bore 228 may be able to receive fastener 224 to removably couple the removably couplable rear sole piece 214 to the removably couplable intermediate sole piece 212 and lower back portion 206. In embodiments, top intermediate sole through 228 may be threaded.

In some embodiments, intermediate fastener 234 may help secure removably couplable intermediate sole piece 212 to the body portion. Similar to fastener 224, intermediate fastener 234 may be made out of metal, plastic, composite, and/or other materials, as described herein.

In some embodiments, intermediate fastener 234 may help secure removably couplable intermediate sole piece 212 to lower back portion 206. A bottom intermediate sole through bore 332 (shown in FIG. 3) and intermediate fastener 234 may be used to help prevent rattling of modular golf club head 200 in a fully coupled state. In some embodiments, additional material may be used on portions of the body portion, the lower back portion 206, removably couplable intermediate sole piece 212, and/or removably couplable rear sole piece 214 to prevent rattling. For example, the additional material (not shown) may include padding, foam, rubber, plastic, adhesive, and/or other materials between these components without departing from the spirit and scope of the presently disclosed technology. In some embodiments, intermediate fastener 234 may not be necessary and fastener 224 may be sufficient for modular golf club head 200. Sole through bore 238 may fit fastener 224. Fastener 224 may removably couple removably couplable rear sole piece 214 and removably couplable intermediate sole piece 212 to body portion via sole through bore 238 of removably couplable rear sole piece 214 and top intermediate sole through bore 228 of removably couplable intermediate sole piece 212 and bore 418 (shown in FIG. 4) on lower back portion 206. In some embodiments, bottom intermediate sole through bore (not shown) may be threaded.

Removably couplable rear sole piece 214 may further include securing element 236 and a trailing edge 215. Coupling removably couplable rear sole piece 214 to removably couplable intermediate sole piece 212 and back 204 may form a substantially continuous shape between face 202 and interchangeable sole 210 to provide a uniform appearance of modular golf club head 200, more clearly illustrated in FIG. 1. The substantially continuous shape may include leading edge 203 and trailing edge 215.

As discussed above and as illustrated, securing element 236 may further include an L-shaped rail to help mechanically secure removably couplable rear sole piece 214 to removably couplable intermediate sole piece 212. In this embodiment, slots 226 may include a similarly shaped undercut to help secure removably couplable rear sole piece 214 to removably couplable intermediate sole piece 212. It should be appreciated that the shapes and/or dimensions of securing element 236 and slots 226 may vary without departing from the spirit and scope of the presently disclosed technology. For example, the securing element may include a U-shaped rail, a C-shaped rail, a straight rail, a T-shaped rail, and/or other shapes that extend throughout removably couplable rear sole piece 214 or as little as 1 mm away from where the rail drops down, as well as anywhere in between. It should also be appreciated that removably couplable rear sole piece 214 may have another securing element (not shown) on the other side of securing element 236 to provide symmetrical support. In some embodiments, there may be more or less securing elements in removably couplable rear sole piece 214.

Figure 3:
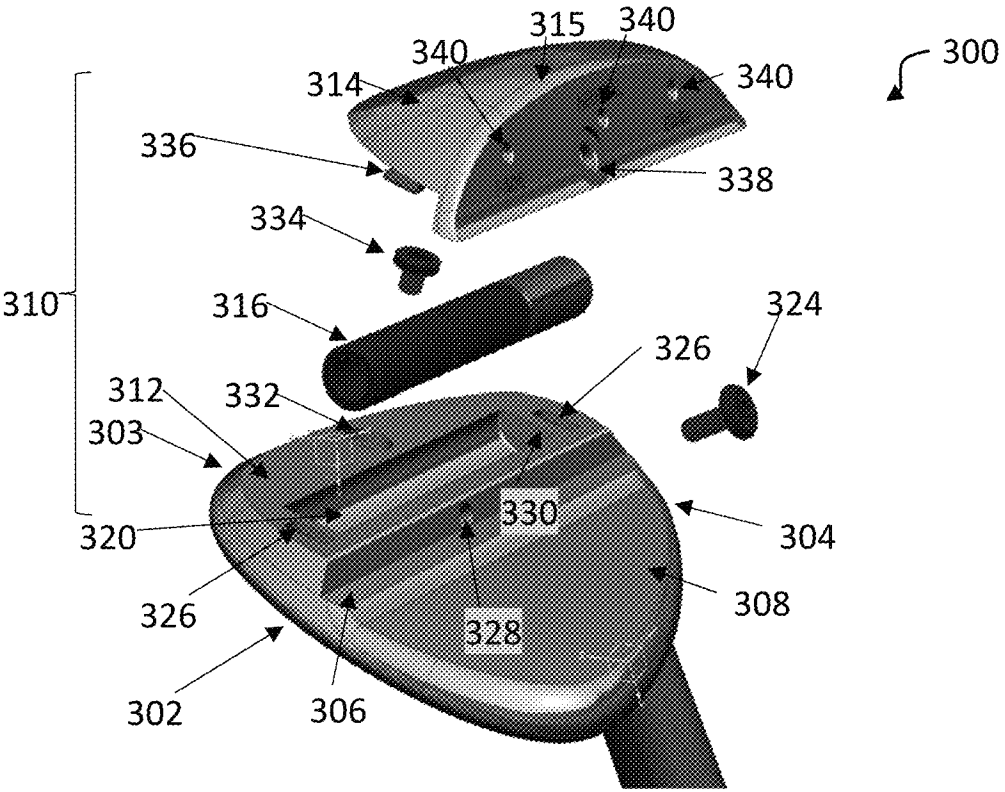
FIG. 3 is a perspective exploded view of a modular golf club head in accordance with one or more embodiments of the presently disclosed technology.

FIG. 3 is a perspective exploded view of modular golf club head 300 in accordance with one or more embodiments of the presently disclosed technology. FIG. 3 illustrates components that may be the same or substantially similar to components illustrated in FIG. 1 and/or FIG. 2. For example, face 102, leading edge 103, upper back portion 108, trailing edge 115, fastener 124, indicators 140, removably couplable rear sole piece 214, weight 216, slots 226, top intermediate sole through bore 228, intermediate fastener 234, securing element 236, and/or sole through bore 238 may be the same as or substantially similar to face 302, leading edge 303, upper back portion 308, trailing edge 315, fastener 324, indicators 340, removably couplable rear sole piece 314, weight 316, slots 326, top intermediate sole through bore 328, intermediate fastener 334, securing element 336, and/or sole through bore 338. As illustrated, lower back portion 306 may further include body recess 320. Body recess 320 may fit weight 316. As illustrated, body recess 320 may be curved to fit the cylindrical shape of weight 316. Body recess 320 may have the same length and width as weight 316, though, as discussed herein, body recess 320 may have dimensions larger than weight 316. As an example, a heel-to-toe body recess length, that is, a length of body recess 320 from the heel to the toe, is at least a heel-to-toe weight length. It should be appreciated that body recess dimensions may include a bottom-to-top body recess width and a rear-to-face body recess depth. In embodiments, where body recess 320 has dimensions larger than weight 316, weight 316 may be pressure fit to stay in a position. For example, additional material, as described herein, may be used on portions of the body portion, the lower back portion 306, removably couplable intermediate sole piece 312, and/or removably couplable rear sole piece 314 to help fit weight 316. The additional material (not shown) may include padding, foam, rubber, plastic, adhesive, and/or other materials between these components that can be compressed during the assembly of the components to prevent relative movement between the components after being coupled. It should be appreciated that the additional material (not shown) may be included as discrete pads at a portion of the contact points between the components or continuous around the components.

In some embodiments, weight 316 may have notches (not shown) and body recess 320 may have corresponding grooves (not shown) to help secure weight 316 into one or more positions in body recess 320. It should be appreciated that there may be other mechanisms to help fix, or secure, weight 316 into one or more positions within body recess 320, including, for example, triangular grooves in weight 316 and triangular notches in body recess 320, pressure fitting weight 316 between interchangeable sole 310 and back 304, fastening weight 316 to removably couplable intermediate sole piece 312, removably couplable rear sole piece 314, or back 304 via a through bore (not shown) in weight 316, a notch-and-groove system between weight 316 and removably couplable intermediate sole piece 312 and/or removably couplable rear sole piece 314, as well as other mechanisms without departing from the spirit and scope of the presently disclosed technology. In some embodiments, body recess 320 may not be necessary. For example, body recess 320 may not be necessary for flat weights, which may fit within intermediate cut-out 330 and/or sole recess 644 (shown in FIG. 6).

Removably couplable intermediate sole piece 312 may further include intermediate cut-out 330 and bottom intermediate sole through bore 332. Bottom intermediate sole through bore 332 may receive intermediate fastener 334. Intermediate cut-out 330 may be dimensioned to fit weight 316. As discussed herein, weight 316 may take various forms and shapes. In some embodiments, weight 316 may be fully contained within dimensions of intermediate cut-out 330. In embodiments, intermediate cut-out depth may be between about 2 and about 10 mm. In some embodiments, the intermediate cut-out dimensions may be larger than the dimensions of weight 316. As described herein, weight 316 may be "fixed" into a position using various mechanisms, including elements on intermediate cut-out 330. As described herein, intermediate cut-out 330 may not be a cut-out and may be an intermediate recess (not shown). In these embodiments, intermediate recess (not shown) may face back 304. Body recess 320 and intermediate recess (not shown) may cover and secure weight 316. In some embodiments, sole recess 644 (shown in FIG. 6) and intermediate recess (not shown) may cover and secure weight 316.

Figure 4:
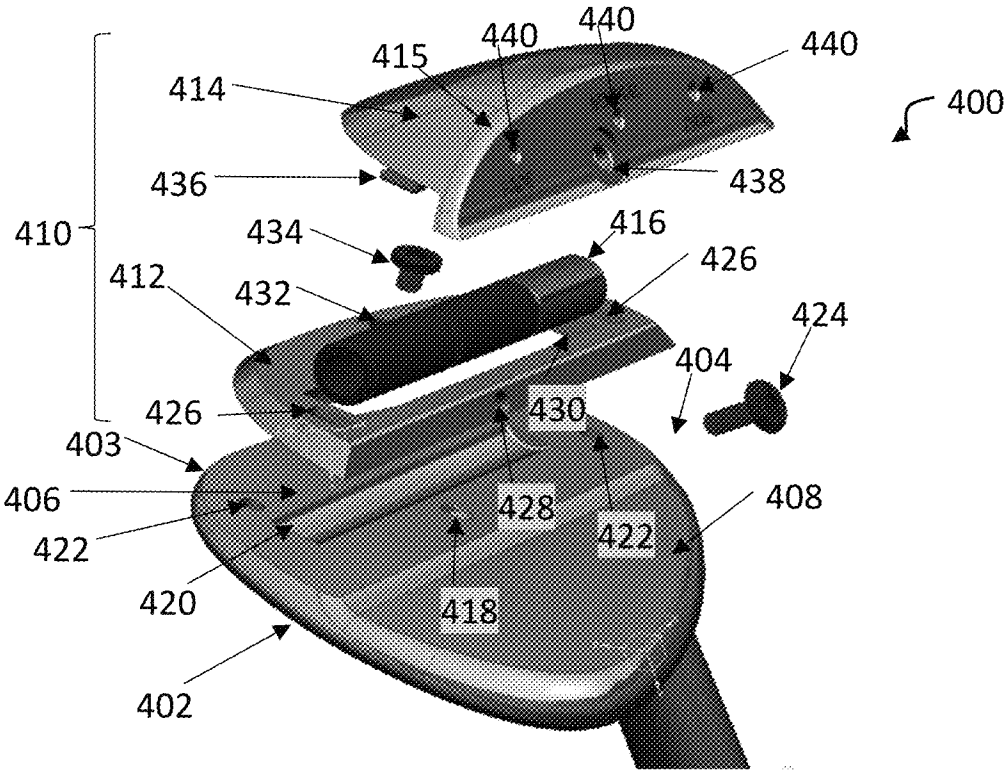
FIG. 4 is a perspective exploded view of a modular golf club head in accordance with one or more embodiments of the presently disclosed technology.

FIG. 4 is a perspective exploded view of modular golf club head 400 in accordance with one or more embodiments of the presently disclosed technology. FIG. 4 illustrates components that may be the same or substantially similar to components illustrated in FIG. 1, FIG. 2, and/or FIG. 3. For example, face 102, leading edge 103, upper back portion 108, trailing edge 115, fastener 124, indicators 140, removably couplable rear sole piece 214, weight 216, slots 226, top intermediate sole through bore 228, intermediate fastener 234, securing element 236, sole through bore 238, body recess 320, intermediate cut-out 330, and/or bottom intermediate sole through bore 332 may be the same as or substantially similar to face 402, leading edge 403, upper back portion 408, trailing edge 415, fastener 424, indicators 440, removably couplable rear sole piece 414, weight 416, slots 426, top intermediate sole through bore 428, intermediate fastener 434, securing element 436, sole through bore 438, body recess 420, intermediate cut-out 430, and/or bottom intermediate sole through bore 432. Lower back portion 406 may further include bore 418 and alignment bores 422. Bore 418 may be threaded. Bore 418 may receive fastener 424. In some embodiments, bore 418 may include a mechanism to secure fastener 424 to the body portion. Removably couplable rear sole piece 414 and removably couplable intermediate sole piece 412 may be secured to lower back portion 406 via fastener 424 and bore 418. In some embodiments, there may be additional bores (not shown) to receive additional fasteners. Though not visible at this angle, intermediate fastener 434 is secured to lower back portion 406 via another bore (not shown). This bore (not shown) may also be threaded, though it should be appreciated another mechanism may be used, as discussed herein. Alignment bores 422 may receive alignment pins 642 (shown in FIG. 6) extending from a front of removably couplable intermediate sole piece 412. Alignment pins 642 (shown in FIG. 6) may be cylindrical, spherical, triangular, pyramidal, or any other shape and/or size to help align removably couplable rear sole piece 410 with back 404. In some embodiments, alignment bores 422 may be on removably couplable intermediate sole piece and alignment pins 642 (shown in FIG. 6) may be on lower back portion 406.

Figure 5:
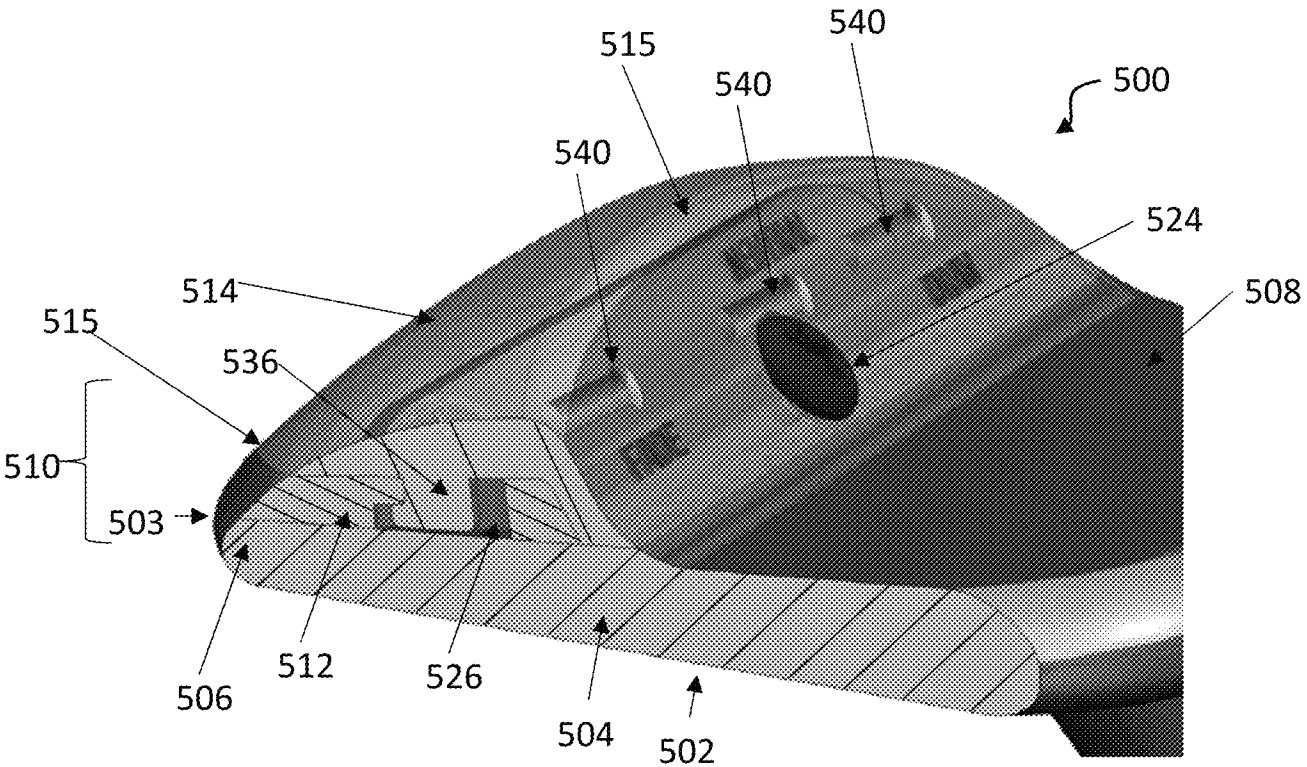
FIG. 5 is a cross-sectional view of a portion of a modular golf club head in accordance with one or more embodiments of the presently disclosed technology.

FIG. 5 is a cross-sectional view of a portion of modular golf club head 500 in accordance with one or more embodiments of the presently disclosed technology. FIG. 5 illustrates components that may be the same or substantially similar to components illustrated in FIG. 1, FIG. 2, FIG. 3, and/or FIG. 4. For example, face 102, leading edge 103, back 104, upper back portion 108, interchangeable sole 110, trailing edge 115, fastener 124, indicators 140, lower back portion 206, removably couplable intermediate sole piece 212, removably couplable rear sole piece 214, slots 226, and/or securing element 236 may be the same as or substantially similar to face 502, leading edge 503, back 504, lower back portion 506, upper back portion 508, interchangeable sole 510, removably couplable intermediate sole piece 512, removably couplable rear sole piece 514, trailing edge 515, fastener 524, indicators 540, slots 526, and/or securing element 536. With the cut away view, slot 526 and securing element 536 may be illustrated more clearly. As illustrated, slot 526 is illustrated with an undercut to fit with L-shaped securing element 536. As described herein, securing element 536 and slot 526 may take different shapes and/or sizes. As illustrated, the undercut may help mechanically secure removably couplable rear sole piece 514 to removably couplable intermediate sole piece 512.

FIG. 5 may more clearly illustrate the difference in thickness between lower back portion 506 and upper back portion 508. As discussed herein, lower back portion 506 may be at different heights compared to upper back portion 508. It should also be appreciated that back 504 may vary in thickness throughout back 504. While modular golf club head 500 is illustrated as solid in this cut away view, it should be appreciated that modular golf club head 500 may be hollow.

FIG. 5 may more clearly illustrate the substantially continuous shape provided by coupling interchangeable sole 510 to the body portion. As illustrated, the substantially continuous shape is a continuous curve from at least leading edge 503 to at least trailing edge 515 that provides a uniform appearance of modular golf club head 500.

Figure 6:
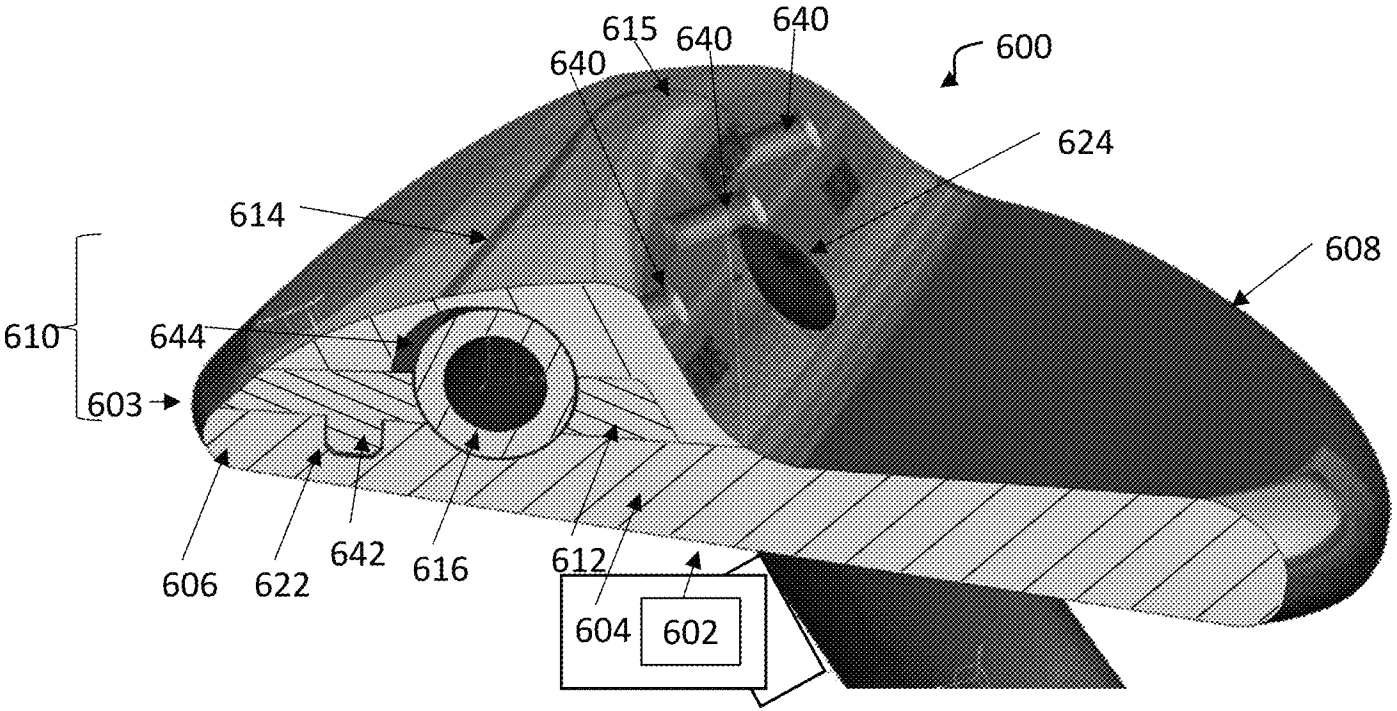
FIG. 6 is a cross-sectional view of a portion of a modular golf club head in accordance with one or more embodiments of the presently disclosed technology.

FIG. 6 is a cross-sectional view of a portion of modular golf club head 600 in accordance with one or more embodiments of the presently disclosed technology. FIG. 6 illustrates components that may be the same or substantially similar to components illustrated in FIG. 1, FIG. 2, FIG. 3, FIG. 4, and/or FIG. 5. For example, face 102, leading edge 103, back 104, upper back portion 108, interchangeable sole 110, trailing edge 115, fastener 124, indicators 140, lower back portion 206, removably couplable intermediate sole piece 212, removably couplable rear sole piece 214, weight 216, and/or alignment bore 422 may be the same as or substantially similar to face 602, leading edge 603, back 604, lower back portion 606, upper back portion 608, interchangeable sole 610, removably couplable intermediate sole piece 612, removably couplable rear sole piece 614, trailing edge 615, fastener 624, indicators 640, weight 616, and/or alignment bore 622. With the cut away view, alignment pin 642 and sole recess 644 are more clearly visible. As illustrated, alignment bore 622 may receive alignment pin 642. As described herein, there may be multiple alignment bores 422 (shown in FIG. 4) to help align removably couplable intermediate sole piece 612 to lower back portion 606. Alignment pin 642 may be square-like with chamfered corners to sit within alignment bore 622, though it should be appreciated that alignment pin 642 may be in a different shape and/or size, as described herein. It should also be appreciated that in some embodiments there may be an alignment pin system (not shown) between removably couplable intermediate sole piece 612 and removably couplable rear sole piece 614.

As illustrated, such an alignment pin system (not shown) may not be necessary because removably couplable intermediate sole piece 612 is dimensioned to be smaller than removably couplable rear sole piece 614, allowing removably couplable rear sole piece 614 to sit against removably couplable intermediate sole piece 612 and slide into place. The upside-down L-shape of removably couplable rear sole piece 614 may provide a sufficient fit with removably couplable intermediate sole piece 612, though it should be appreciated that removably couplable rear sole piece 614 may be flat in some embodiments, instead of upside-down L-shaped, and an alignment pin system (not shown) may be used. It should also be appreciated that back 604 may be designed to fit removably couplable intermediate sole piece 612 without an alignment pin system. For example, more of lower back portion 606 may be cut away, while leaving the lower edge of the body portion untouched, to create a v-shaped cut-out, which may allow removably couplable intermediate sole piece 612 shaped to fit the new v-shaped cut-out to sit itself into a proper position. Removably couplable rear sole piece 614 may still fit with removably couplable intermediate sole piece 612 similarly to how interchangeable sole 610 is illustrated in FIG. 6.

Modular golf club head 600 may more clearly illustrate sole recess 644. As illustrated, sole recess 644 may receive cylindrical weight 616, though it should be appreciated that the shape and size of sole recess 644 may vary based on the dimensions of weight 616, as described herein. Weight 616 may be semi-hollow. In some embodiments, weight 616 may be solid or hollow, as described herein. A first portion of weight 616 may be hollow, and a second portion heel-ward of the cut away, may be solid. The first portion may include plastic and the second portion may include metal. The two portions may be assembled by gluing, welding, fastening, and/or otherwise combining the two portions together.

Figure 7:
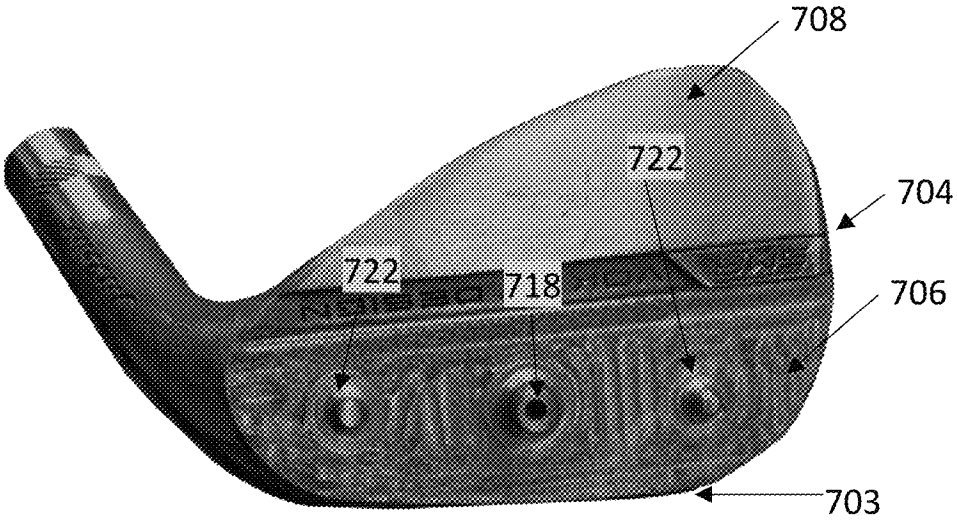
FIG. 7 is a rear view of a body portion of a modular golf club head in accordance with one or more embodiments of the presently disclosed technology.

FIG. 7 is a rear view of a body portion of a modular golf club head in accordance with one or more embodiments of the presently disclosed technology. FIG. 7 illustrates components that may be the same or substantially similar to components illustrated in FIG. 1. For example, leading edge 103 and/or upper back portion 108 may be the same as or substantially similar to leading edge 703 and/or upper back portion 708. Lower back portion 706 of back 704 may include alignment pins 722 and protruded bore 718. As described herein, alignment pins 722 may be on lower back portion 706 and/or interchangeable sole 810 (shown in FIG. 8). Alignment pins 722 may fit with bores (not shown) on interchangeable sole 810 (shown in FIG. 8).

Figure 8:
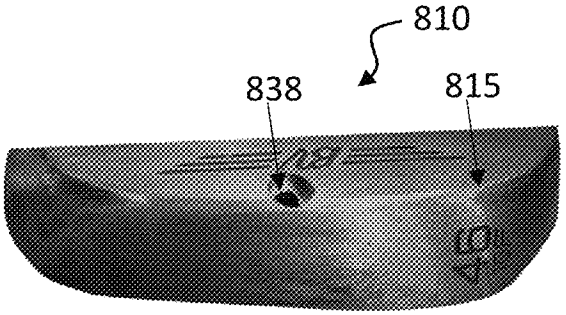
FIG. 8 is a rear view of an interchangeable sole in accordance with one or more embodiments of the presently disclosed technology.

FIG. 8 is a rear view of an interchangeable sole 810 in accordance with one or more embodiments of the presently disclosed technology. Interchangeable sole 810 may include a trailing edge 815, through bore hole 838, and bores (not shown). Interchangeable sole 810 may fit with body portion illustrated in FIG. 7. As illustrated, interchangeable sole 810 may have a 10 degree bounce angle and an f grind. Interchangeable sole 810 may fit with a body portion having a 46 degree loft. Through bore hole 838 may receive a fastener. In some embodiments, through bore hole 838 may be threaded. On an opposite side of through bore hole 838, interchangeable sole 810 may include a bore (not shown) to fit with protruded bore 718. In some embodiments, the bore (not shown) and/or protruded bore 718 may be threaded to help secure a fastener (not shown), as described herein. Interchangeable sole 810 may be a multi-material component. The multi-material interchangeable sole 810 may be dual-density. In some embodiments, a first material may be located substantially face-ward, that is toward a face, and a second material may be located substantially rearward, that is toward a rear, causing the modular golf club head to be weight-biased toward the face or vice versa, where the first material may be located substantially rearward and the second material may be located substantially face-ward. In embodiments, the first material may be located substantially heel-ward, that is, toward the heel, and a second material may be located substantially toe-ward, that is, toward the toe, causing the modular golf club head to be weight-biased toward a heel or vice versa. In some embodiments, the first material may be located substantially bottom-ward, that is, toward the bottom, and a second material may be located substantially top-ward, that is, toward the top, causing the modular golf club head to be weight-biased toward a bottom or vice versa. It should be appreciated that the first material may be positioned in a combination of all three locations, face-ward, toe-ward, and bottom-ward, or degrees of these three, or their opposites, without departing from the spirit and scope of the presently disclosed technology. In embodiments, substantially face-ward, rearward, toe-ward, heel-ward, bottom-ward, and top-ward may mean the material or the material's weight distribution is at or greater than fifty percent toward the identified direction. In some embodiments, substantially may mean at or greater than seventy-five percent, ninety percent, or higher, or anywhere in between without departing from the spirit and scope of the presently disclosed technology.

Figure 9:
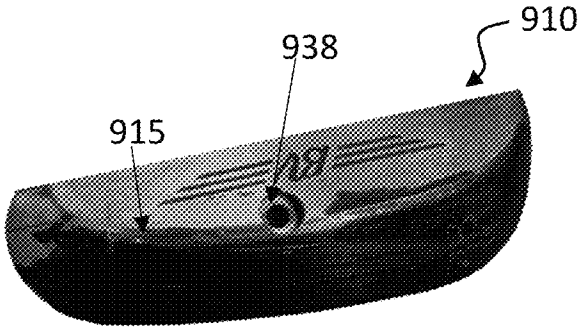
FIG. 9 is a rear view of an interchangeable sole in accordance with one or more embodiments of the presently disclosed technology.

FIG. 9 is a rear view of interchangeable sole 910 in accordance with one or more embodiments of the presently disclosed technology. FIG. 9 illustrates components that may be the same or substantially similar to components illustrated in FIG. 8. For example, interchangeable sole 810, trailing edge 815, and/or through bore holes 838 may be the same as or substantially similar to interchangeable sole 910, trailing edge 915, and/or through bore holes 938. Having the same interchangeable sole 910 may allow for a user with a worn face on a body portion to keep the same grind, bounce angle, width, and/or other characteristics of interchangeable sole 910 the same for a new body portion with a new face. In some embodiments, interchangeable sole 910 may have a different weight bias. The darker shade between leading edge 703 (shown in FIG. 7) and trailing edge 915 may indicate a heel-ward, a toe-ward, a face-ward, a rearward, a bottom-ward, and/or a top-ward weight bias, while interchangeable sole 810 without the paint may indicate a neutral weight bias. It should be appreciated that other interchangeable soles may use other visual indicators to indicate a weight bias, width, bounce angle, and/or grind.

Other than in at least some of the operating examples, or unless otherwise expressly specified, all of the numerical ranges, amounts, values and percentages such as those for amounts of materials, moment of inertias, center of gravity locations, loft, angles, various ratios, and others in the aforementioned portions of the specification may be read as if prefaced by the word "about" even though the term "about" may not expressly appear in the value, amount, or range. Accordingly, unless indicated to the contrary, the numerical parameters set forth in the above specification and appended claims are approximations that may vary depending upon the desired properties sought to be obtained by the presently disclosed technology. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the presently disclosed technology are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

While various embodiments of the disclosed technology have been described above, it should be appreciated these are examples only, and not limiting. Likewise, the various figures may depict an example configuration or structure to aid in understanding the features and functionality that can be included in the disclosed technology. The presently disclosed technology is not intended to be restricted to the illustrated example configurations and structures, and the desired features can be implemented with a variety of alternative configurations and structures. It may be apparent to one of skill in the art how alternative embodiments can be implemented to impart the desired features of the presently disclosed technology. Therefore, it will be understood that the appended claims are intended to cover all such modifications and embodiments, which would come within the spirit and scope of the presently disclosed technology.

While the presently disclosed technology may be described herein in terms of various exemplary embodiments, it should be understood that the various features described in any individual embodiment is not limited to its particular embodiment, and can be applied, whether alone or in combinations with features of other embodiments, to another embodiment, whether or not such an embodiment is described herein or described as part of a single embodiment. Thus, the breadth and scope of the presently disclosed technology should not be limited to any of the above-described exemplary embodiments.

Words, phrases, and their variations that are used herein, unless otherwise expressly stated, should be construed as open ended, not as limiting. For example, the term "include" should be read to mean "include, without limitation"; the term "example" should be read to mean the following provides exemplary instances, not an exhaustive or limiting list thereof; "a" or "an" should be read as meaning "at least one," "one or more" etc.; and "traditional," "normal," and similar terms should not be construed as limiting to a given time period, but should be read to encompass traditional, normal, like technologies that may be known now or at any future point. In addition, references herein to technologies that would be apparent or known to one of ordinary skill in the art includes such technologies that are apparent or known to one of ordinary skill in the art now or at any time in the future.

The presence of words and phrases such as "one or more," "at least," "not limited to," or other similar phrases shall not be read to necessarily mean that the narrower case is intended in instances where such broadening phrases may be absent. The presence of words such as "first," "second," or other similar words shall not be read to mean that there can only be one or two elements.

We claim:

1. A modular golf club head, comprising:

a body portion comprising:

a face; and a back extending rearward from at least a first portion of the face; and at least one interchangeable sole to fit with the back, wherein the at least one interchangeable sole comprises:

a removably couplable intermediate sole piece to fit with at least a second portion of the back, wherein the removably couplable intermediate sole piece is removably couplable to the back; and a removably couplable rear sole piece to fit with the removably couplable intermediate sole piece, wherein the removably couplable rear sole piece is removably couplable to the removably couplable intermediate sole piece and the back;

wherein coupling the at least one interchangeable sole to the body portion causes the modular golf club head to comprise a bounce angle between about 2° and about 20°.

2. The modular golf club head of claim 1, wherein the back comprises:

a threaded bore to receive a fastener;

wherein the removably couplable intermediate sole piece comprises:

an intermediate sole through bore to receive the fastener to removably couple the removably couplable rear sole piece to the removably couplable intermediate sole piece and the back; and wherein the removably couplable rear sole piece comprises:

a sole through bore to receive the fastener to removably couple the removably couplable rear sole piece to the removably couplable intermediate sole piece and the back.

3. The modular golf club head of claim 1, wherein the removably couplable intermediate sole piece further comprises an intermediate through bore to receive an intermediate fastener to removably couple the removably couplable intermediate sole piece to the back.

4. The modular golf club head of claim 1, wherein the back further comprises:

a bore to receive an alignment pin, wherein the removably couplable intermediate sole piece further comprises:

the alignment pin to help secure the removably couplable intermediate sole piece to the back via the bore; and a slot to receive a securing element; and wherein the removably couplable rear sole piece further comprises:

the securing element to help secure the removably couplable rear sole piece to the removably couplable intermediate sole piece via the slot.

5. The modular golf club head of claim 1, wherein the back further comprises:

a body recess to receive an adjustable weight, wherein a heel-to-toe body recess length is longer than a heel-to-toe weight length of the adjustable weight;

wherein the removably couplable intermediate sole piece further comprises:

an intermediate cut-out extending from a front through to a back of the removably couplable intermediate sole piece to receive the adjustable weight, wherein a heel-to-toe cut-out length is at least the heel-to-toe body recess length; and wherein the removably couplable rear sole piece further comprises:

a sole recess on a front of the removably couplable rear sole piece to receive the adjustable weight, wherein a heel-to-toe sole recess length is at least the heel-to-toe body recess length.

6. The modular golf club head of claim 5, wherein coupling the at least one interchangeable sole to the body portion secures the adjustable weight into a fixed position.

7. The modular golf club head of claim 5, wherein the removably couplable rear sole piece further comprises an indicator to indicate a position of the adjustable weight along the modular golf club head.

8. The modular golf club head of claim 1, wherein the at least one interchangeable sole comprises a first material and a second material, wherein the first material is denser than the second material.

9. The modular golf club head of claim 8, wherein the first material is located substantially face-ward and a second material is located substantially rearward causing the modular golf club head to be weight-biased toward the face or vice versa.

10. The modular golf club head of claim 8, wherein the first material is located substantially heel-ward and a second material is located substantially toe-ward causing the modular golf club head to be weight-biased toward a heel or vice versa.

11. The modular golf club head of claim 1, wherein coupling the at least one interchangeable sole to the body portion causes the modular golf club head to comprise one of an f grind, an s grind, an m grind, a d grind, an l grind, and a k grind.

12. A modular golf club head, comprising:

a body portion comprising:

a face; and a back extending rearward from at least a first portion of the face, wherein the back comprises:

a body recess to receive an adjustable weight, wherein a heel-to-toe body recess length is longer than a heel-to-toe weight length of the adjustable weight; and at least one interchangeable sole to fit with the body portion, wherein the at least one interchangeable sole comprises:

a recess on a front of the at least one interchangeable sole to receive the adjustable weight, wherein a heel-to-toe recess length is at least the heel-to-toe body recess length;

a removably couplable intermediate sole piece to fit with the back, wherein the removably couplable intermediate sole piece is removably couplable to the back, and wherein the removably couplable intermediate sole piece further comprises:

an intermediate cut-out extending from a front through to a back of the removably couplable intermediate sole piece to receive the adjustable weight, wherein a heel-to-toe cut-out length is at least the heel-to-toe recess length; and a removably couplable rear sole piece to fit with the removably couplable intermediate sole piece, wherein the removably couplable rear sole piece is removably couplable to the removably couplable intermediate sole piece and the back, wherein the removably couplable rear sole piece further comprises:

a sole recess on a front of the removably couplable rear sole piece to receive the adjustable weight, wherein a heel-to-toe sole recess length is at least the heel-to-toe body recess length; and wherein the recess comprises:

the intermediate cut-out; and the sole recess.

13. The modular golf club head of claim 12, wherein the back further comprises:

a threaded bore to receive a fastener; and wherein the at least one interchangeable sole comprises a through bore to receive the fastener to removably couple the at least one interchangeable sole to the back.

14. The modular golf club head of claim 13, wherein the back comprises:

a threaded bore to receive a fastener;

wherein the at least one interchangeable sole comprises:

a through bore to receive the fastener to removably couple the at least one interchangeable sole to the back;

wherein the removably couplable intermediate sole piece comprises:

an intermediate sole through bore to receive the fastener to removably couple the removably couplable rear sole piece to the removably couplable intermediate sole piece and the back; and wherein the removably couplable rear sole piece comprises:

a sole through bore to receive the fastener to removably couple the removably couplable rear sole piece to the removably couplable intermediate sole piece and the back.

15. A modular golf club head, comprising:

a body portion comprising:

a face; and a back extending rearward from at least a first portion of the face, wherein the back comprises:

a body recess on a rear of the back to receive an adjustable weight, wherein the body recess is larger in at least one body dimension than a corresponding dimension of the adjustable weight; and at least one interchangeable sole to fit with the back, wherein the at least one interchangeable sole comprises a first side and a second side on an opposite end of the first side, wherein the at least one interchangeable sole is weight-biased toward at least a first side, and wherein the at least one interchangeable sole further comprises: the adjustable weight; and a recess on a front of the at least one interchangeable sole to receive the adjustable weight, wherein a recess dimension is at least the at least one body dimension.

16. The modular golf club head of claim 15, wherein the first side comprises a first material, wherein the second side comprises a second material, and wherein the first material is denser than the second material.

17. The modular golf club head of claim 15, wherein coupling the at least one interchangeable sole to the back forms a substantially continuous shape between the face and a sole back of the at least one interchangeable sole to provide a uniform appearance of the modular golf club head, wherein the substantially continuous shape comprises:

a leading edge; and a trailing edge.

* * * * *